United States Patent [19]

Josephson

[11] 4,241,539

[45] Dec. 30, 1980

[54] SEAL FOR SIDES OF PIVOTED BLADE STRUCTURES

[75] Inventor: Louis Josephson, Yonkers, N.Y.

[73] Assignee: American Hardware & Paint Co., Inc., Elizabeth, N.J.

[21] Appl. No.: 4,488

[22] Filed: Jan. 18, 1979

[51] Int. Cl.[2] ..... E06B 7/23; E06B 7/098

[52] U.S. Cl. ..... 49/91; 49/495; 98/110; 98/121 A

[58] Field of Search ..... 49/91, 92, 475, 495; 98/121 A, 110

[56] References Cited

U.S. PATENT DOCUMENTS

| | | | |
|---|---|---|---|
| 3,055,284 | 9/1962 | Pellegrini | 49/62 |
| 3,484,990 | 12/1969 | Kahn et al. | 49/91 |
| 3,518,792 | 7/1970 | Williamson et al. | 49/495 X |
| 3,581,884 | 6/1971 | Caldwell et al. | 49/475 X |
| 3,718,081 | 2/1973 | Root | 49/91 X |
| 3,783,768 | 1/1974 | Caming et al. | 98/110 |
| 4,112,623 | 9/1978 | McPherson | 49/495 X |

*Primary Examiner*—Philip C. Kannan

*Attorney, Agent, or Firm*—Dressler, Goldsmith, Shore, Sutker & Milnamow

[57] ABSTRACT

The sides of the blades in a pivoted blade structure are mounted against a laterally curved, relatively rigid, side seal strip having centrally positioned on the protruding portion of the curve a series of laterally spaced soft and flexible longitudinally extending teeth. The sides of the pivoted blades are supported by these teeth and are sealed by these teeth when the blades are in a closed position.

7 Claims, 4 Drawing Figures

SEAL FOR SIDES OF PIVOTED BLADE STRUCTURES

DESCRIPTION

Technical Field

This invention relates to pivoted blade structures, such as dampers, shutters and louvers where it is desired to seal the sides of the blades so as to better prevent the flow of air through the structure when the blades are in their closed position.

Background Art

Pivoted blade structures, and especially multiblade dampers, are intended to shut off the flow of air through the damper when the blades are in their closed position. To the extent that air flow continues when the damper is closed, then an unnecessary energy load is imposed on the air circulating system under consideration, and this can be quite costly. There are three sources of leakage, namely: 1—Between the blades; 2—At the top and bottom of the series of blades where the upper and lower blades mate with the top and bottom of the frame holding the blades; and 3—At the sides of the blades adjacent the sides of the frame. This third source of leakage has not been adequately handled heretofore, and it is the one combated by this invention. At the present time a laterally curved strip (like a venetian blind slat) is mounted at the sides of the frame and then a curved washer is used to enable rotation of the blades, and there is no precise seal of the sides of the blades against the laterally curved strip when the blade is in its closed position.

DISCLOSURE OF INVENTION

In accordance with this invention, a laterally curved relatively rigid side seal strip is employed, the central protruding portion thereof carrying a series of laterally spaced soft and flexible longitudinally extending teeth. When the blades are pivoted into their closed position, they engage one or more of the flexed teeth which provides an effective seal. These flexible teeth resiliently support the central section of the pivoted blades, so the "Delrin" washer which is normally interposed between the side of each blade and the side seal strip can be eliminated without having the blades bind. This not only eliminates being sure that these washers are used at both sides of every blade, but the washer itself introduces a small air gap of 3–4 mils which is eliminated herein.

The laterally curved relatively rigid side seal strips of this invention are longitudinally straight slat-like elements which are formed by extrusion. Two plastics are used, a relatively rigid plastic for the curved body of the strip, and a soft and flexible plastic for the teeth. Polyvinyl chloride is a typical plastic for this purpose, and it would be more heavily plasticized to provide the soft and flexible teeth. The continuous extrusion of two plastics to provide items of a dual durometer nature is itself well known. The extrusion may be continuous and the product thereof placed in a coil which is unwound and cut as needed to line the sides of the frame which is to hold the pivoted blades.

The teeth desirably occupy the central 15–50% of the width of the side seal body which is typically from 1 to 3 inches in width. The height of a typical tooth will range from 1/32 inch to $\frac{1}{4}$ inch while the base of the tooth will range from $\frac{1}{8}$ to $\frac{1}{2}$ of its height. The bases of the teeth are preferably adjacent to one another, but they can be spaced apart a distance up to the height of the tooth. Closer spacing not exceeding $\frac{1}{3}$ the tooth height is preferred. The tooth hardness need merely be soft enough to flex and move out of the way as the blade passes across it. This will vary with the height and the thickness of the teeth. Thus, the blade will only be stopped when it reaches its closed position which will be in sealing relation to one or more of the flexed teeth.

The upper reach of the teeth may provide a level surface, or it may form a slight arc which may be either concave or convex. Also, the side seal body will be laterally curved over a radius of curvature which is the same as the width of the body or up to about 3 times the width of the body.

BRIEF DESCRIPTION OF DRAWINGS

The invention will be more fully described in connection with the accompanying drawings in which.

BEST MODE FOR CARRYING OUT THE INVENTION

Figure 2:
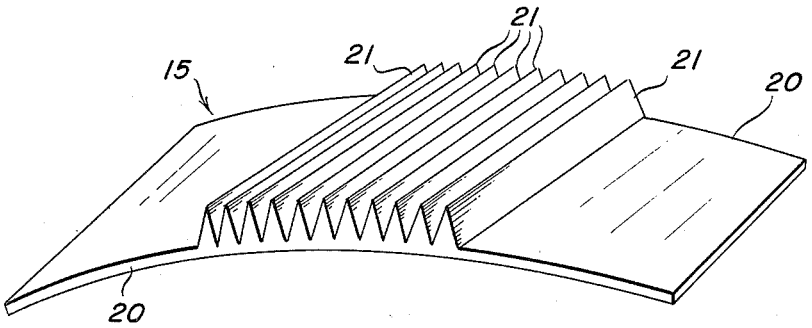
FIG. 2 is a partial perspective view of a section of the side seal extrusion.

The best mode for carrying out the invention will be sest seen in FIG. 2 where the side seal extrusion 15 is formed with a curved thin body portion 20 and integral teeth 21. The body 20 is of hard polyvinyl chloride and the teeth 21 are of soft and flexible plasticized polyvinyl chloride. The thickness of the body is 0.018 inch and the width of the body is 1.75 inch (the side of the frame is 2.0 inch to receive it). The teeth extend over the central 0.75 inch of the body 20, and they extend upwardly to a height of 0.0625 inch above the highest reach of the curved body portion. The curvature of the body portion has a radius of 3 inches. Each tooth has a base of 0.032 inch.

Figure 1:
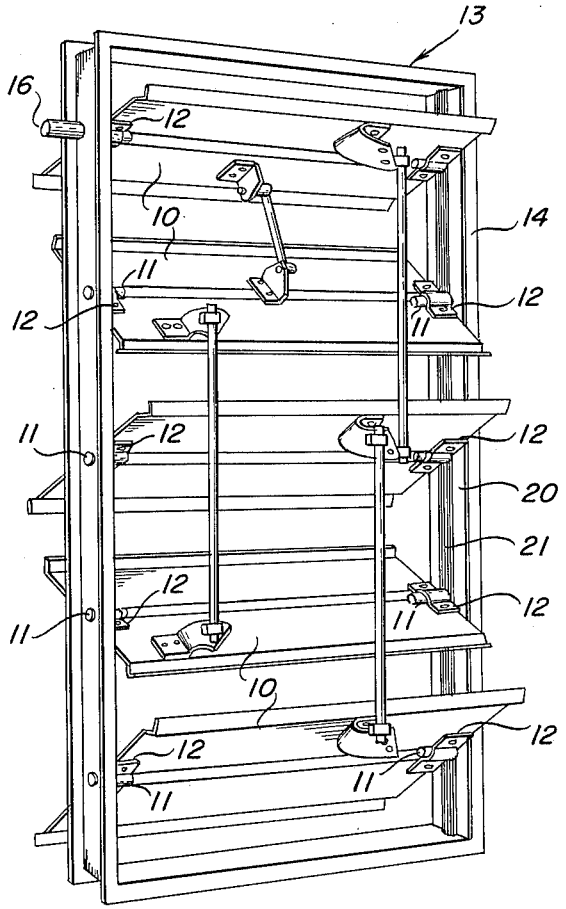
FIG. 1 is a perspective view of an illustrative damper to which the side sealing arrangement of this invention is applicable.
Figure 4:
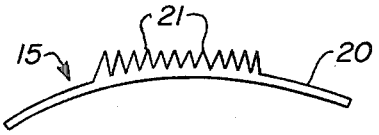
FIG. 4 is a cross-section showing the FIG. 2 structure with teeth having a level upper reach Referring more particularly to FIG. 1, a typical opposed multi-blade damper is shown in which the blades 10 are bent as pictured and clamped to bearings 11 by brackets 12 for pivotal mounting in the side members of frame 13. These side members are identified at 14 and the side seals 15 of this invention are secured to their inner faces so that the bearings 11 extend sidewardly from the blades 10 to extend through openings in the side seals 15 and then through openings in the side members 14. One of the bearings extends further than the others, as shown at 16, and it is usually connected to motorized drive means so that all of the blades can be moved together to either open or shut the damper as desired.
Figure 3:
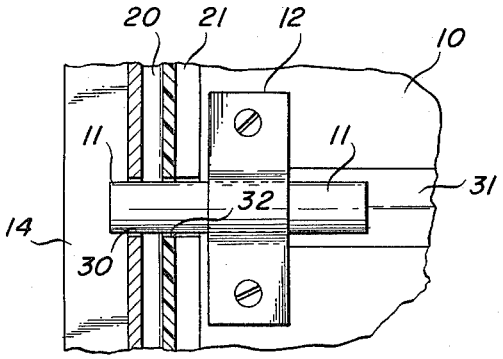
FIG. 3 is a cross-section on an enlarged scale 15 showing a portion of a damper blade mounted for pivotal movement using the side seal extrusion of this invention.

In FIG. 3, the side member 14 is formed with an opening 30 to receive the bearing 11 which is secured to a central bent portion 31 of blade 10 by the brackets 12. The side seal is apertured at 32 so that bearing 11 passes through it, and this aperture 32 extends through both the body 20 and the teeth 21. The FIG. 4 showing is approximately to scale and shows the upper reach of the teeth 21 being level.

INDUSTRIAL APPLICABILITY

The side seal extrusion of FIG. 2 can be formed continually and coiled and sold in a box from which desired lengths can be withdrawn for securement to the inner face of damper frames as shown in FIG. 3. this enables new pivoted blade structures to be closed more securely, and these same side seals can be used to retrofit existing dampers and like structures which leak.

What is claimed is:

1. A laterally curved relatively rigid side seal strip having centrally positioned on the portruding portion of the curve a series of laterally spaced soft and flexible longitudinally extending teeth, said strip being a longitudinally straight slat-like extrusion in which the curved body portion of the strip is formed from hard plastic, and the teeth are formed of soft plastic, the lateral curvature of said strip having a radius of the width of the strip up to about 3 times the width of the strip and the upper reach of the teeth being approximately level.

2. A side seal strip as recited in claim 1 in which said hard and soft plastics are constituted by polyvinyl chloride plasticized to provide the desired hardness and softness.

3. A side seal strip as recited in claims 1 or 2 in which said teeth occupy the central 15–50% of the width of the strip.

4. A side seal strip as recited in claim 3 in which the height of the teeth range from 1/32 inch to $\frac{1}{4}$ inch.

5. A side seal strip as recited in claim 4 in which the base of said teeth range from $\frac{1}{8}$ to $\frac{1}{2}$ of their height.

6. A side seal strip as recited in claim 3 in which the base of said teeth are not more than about $\frac{1}{3}$ the tooth height apart.

7. A pivoted blade structure comprising a frame having side members with at least one blade mounted for pivotal movement between said side members, and the side seal strip of claims 1 or 2 mounted between the sides of the blade and the side members of the frame with the sides of the blade contacting the soft and flexible teeth of the side seal strip.

* * * * *